United States Patent [19]

Nemoto et al.

[11] Patent Number: 4,875,446

[45] Date of Patent: Oct. 24, 1989

[54] SYSTEM AND METHOD FOR CONTROLLING AN ENGINE IDLING SPEED FOR AN INTERNAL COMBUSTION ENGINE

[75] Inventors: Toshikazu Nemoto; Shinsuke Nakazawa, both of Kanagawa, Japan

[73] Assignee: Nissan Motor Company, Limited, Japan

[21] Appl. No.: 177,913

[22] Filed: Mar. 31, 1988

[30] Foreign Application Priority Data

Apr. 9, 1987 [JP] Japan ..... 62-85680

[51] Int. Cl.[4] ..... F02M 3/12

[52] U.S. Cl. ..... 123/339

[58] Field of Search ..... 123/339, 340, 349, 378, 123/402, 403, 587, 588

[56] References Cited

U.S. PATENT DOCUMENTS

| | | | |
|---|---|---|---|
| 4,381,746 | 5/1983 | Miyagi et al. | 123/588 |
| 4,449,498 | 5/1984 | Horiuchi | 123/339 |
| 4,492,195 | 1/1985 | Takahashi et al. | 123/339 |
| 4,617,889 | 10/1986 | Nishimiya et al. | 123/339 |
| 4,619,230 | 10/1986 | Collonia | 123/339 |
| 4,649,877 | 3/1987 | Yasuoka et al. | 123/339 |
| 4,653,449 | 3/1987 | Kamei et al. | 123/339 |
| 4,672,935 | 6/1987 | Abe | 123/339 |
| 4,672,936 | 6/1987 | Abe | 123/339 |
| 4,691,675 | 9/1987 | Iwaki | 123/339 |
| 4,694,798 | 9/1987 | Kato et al. | 123/339 |
| 4,700,674 | 10/1987 | Iwata | 123/339 |
| 4,716,871 | 1/1988 | Sakamoto et al. | 123/339 |

FOREIGN PATENT DOCUMENTS

| | | | |
|---|---|---|---|
| 32-58181 | 4/1957 | Japan | 123/339 |
| 62-57750 | 4/1987 | Japan | 123/339 |

*Primary Examiner*—R. A. Nelli

*Attorney, Agent, or Firm*—Lowe, Price, LeBlanc, Becker & Shur

[57] ABSTRACT

An improved system and method for controlling an engine idling speed for an internal combustion engine are disclosed in which an electromagnetic valve for controlling fluid flow quantity passing through a bypass passage of an engine throttle valve is provided, a water jaket for circulating an engine cooling water is provided so as to surround a coil portion of the electromagnetic valve. The change characteristic of the fluid flow quantity for the electromagnetic valve is varied according to the engine cooling water temperature, and both an optimum target idling speed and feedback control coefficients in a control variable of an opening angle of the electromagnetic valve, i.e., a voltage duty ratio applied to the electromagnetic valve are varied according to the engine cooling water temperature.

16 Claims, 4 Drawing Sheets

SYSTEM AND METHOD FOR CONTROLLING AN ENGINE IDLING SPEED FOR AN INTERNAL COMBUSTION ENGINE

BACKGROUND OF THE INVENTION

1. Field of the Invention

The present invention relates to a system and method for controlling an engine idling speed for an internal combustion engine. The present invention specifically relates to the system and method therefor which can control the engine idling speed to an optimum value stably from a start at a low ambient temperature to a warm-up state.

2. Background of the Art

A Japanese Utility Model Application First (Unexamined) Publication No. sho 57-58181 published on Apr. 6, 1982 exemplifies a previously proposed engine idling speed controlling system in which an electromagnetic valve for controlling an airflow quantity in a passage bypassing a throttle valve of the engine is installed so that the engine idling speed is fed back to coincide with a target engine idling speed.

In addition, a Japanese Utility Model Application First (Unexamined) Publication sho 62-57750 published on Apr. 10, 1987 exemplifies another system for controlling the engine idling speed with a change in an engine cooling water temperature taken into account.

In the latter system disclosed in the above-identified Japanese Utility Model Application Publication, a water jacket is installed as a cooling water chamber in a periphery of a coil portion of the electromagnetic valve and a magnetic force generated by the coil portion is varied according to a temperature of the cooling water so that a change characteristic of the airflow quantity in the bypass passage is varied by means of the electromagnetic valve for each temperature of the engine cooling water.

Therefore, a maximum air quantity derived by means of the electromagnetic valve at a temperature of the predetermined coil portion after warm-up of the engine can be reduced to a required airflow quantity. Therefore, even if the valve remains open due to inoperation of the valve caused by an overrun of a corresponding program or dirt contained in the intake air of the engine, the excessive increase in the engine idling speed can be prevented.

However, since the airflow quantity characteristic of the electromagnetic valve with respect to a voltage duty ratio of a signal applied to the coil portion of the electromagnetic valve is set so as to vary for each cooling water temperature, in the previously proposed latter engine idling speed controlling system, the following problem arises.

That is to say, in the feedback control of the idling speed, an actual engine speed calculated on the basis of a signal derived from a crank angle sensor or ignition coil is compared with a target engine speed determined depending on the cooling water temperature detected by a cooling water temperature sensor. If there is a difference in the comparison result, a control variable, i.e., control coefficient of the electromagnetic valve is corrected according to the difference so that the engine speed reaches the target engine speed. At this time, feedback control coefficients in the proportional-integration (P-I) feedback control mode, i.e., integration (I) and proportional (P) coefficients are defined. In details, the actual engine speed is compared with the target vehicle speed. When the actual engine speed is higher, the control integration coefficient is reduced by a predetermined integration quantity (I) with time. On the contrary, if the actual engine speed is smaller, the control integration coefficient is increased by the predetermined integration quantity (I). In addition, when the difference exceeds a predetermined value and the actual engine speed is smaller, the control proportional coefficient (P) in proportion to the difference is generated.

Since the feedback control coefficients are constant (integration and proportional coefficients) when the actual engine speed is controlled to match with the target engine speed determined according to the engine cooling water temperature, it takes a long time for the actual engine speed to reach the target engine speed. In addition, a hunting occurs after or before the target engine speed.

SUMMARY OF THE INVENTION

It is therefore an object of the present invention to provide a system and method for controlling an engine idling speed for an internal combustion engine in which an optimum engine target idling speed and optimum control coefficients are varied according to an engine cooling water temperature during the engine idling speed control so that a stable engine idling speed control can be achieved without hunting and without excessive increase of the engine idling speed.

The above-described object can be achieved by providing a system for controlling an engine idling speed for an internal combustion engine, comprising: (a) first means for detecting an engine operating condition, the first means including a sensor for detecting an engine speed; (b) second means for determining whether the engine falls in an engine idling condition on the basis of the engine operating condition; (c) third means for controlling a fluidflow quantity passing through a bypass passage installed in an intake air passage of the engine when the engine falls in the engine idling state on the basis of an input signal having a controlled duty ratio, the duty ratio being varied according to the engine operating condition, so that the engine speed detected by the sensor coincides with a target engine speed determined according to the engine operating condition; and (d) fourth means for varying the fluidflow quantity characteristic of the third means according to the engine operating condition.

The above-described object can also be achieved by providing a system for controlling an engine idling speed for an internal combustion engine, comprising: (a) first means for detecting an engine operating condition, the first means including a sensor for detecting an engine idling speed; (b) second means for determining whether the engine falls in an engine idling condition on the basis of the engine operating condition; (c) third means for setting a target engine idling speed according to the engine operating condition; and (d) fourth means for controlling the engine idlind speed according to the engine operating condition so that the engine speed coincides with the target engine idling speed when the second means determines that the engine falls in the engine idling condition, a control variable of the fourth means including a proportional control coefficient and integration control coefficient, at least one of both control coefficients being varied according to the engine operating condition.

The above-described object can also be achieved by providing a method for controlling an engine idling speed for an internal combustion engine, comprising the steps of: (a) detecting an engine operating condition including the engine idling speed; (b) determining whether the engine falls in the engine idling condition on the basis of the engine operating condition detected in the step (a); (c) setting a target engine idling speed according to the engine operating condition; and (d) controlling the engine idling speed according to the detected engine operating condition when the engine falls in the engine operating condition so that the engine idling speed coincides with the target engine idling speed, a control variable thereof including a proportional control coefficient and integration control coefficient both of which are varied according to the engine operating condition.

BRIEF DESCRIPTION OF THE INVENTION

DETAILED DESCRIPTION OF THE PREFERRED EMBODIMENT

Reference will hereinafter be made to the drawings in order to facilitate understanding of the present invention.

Figure 1:
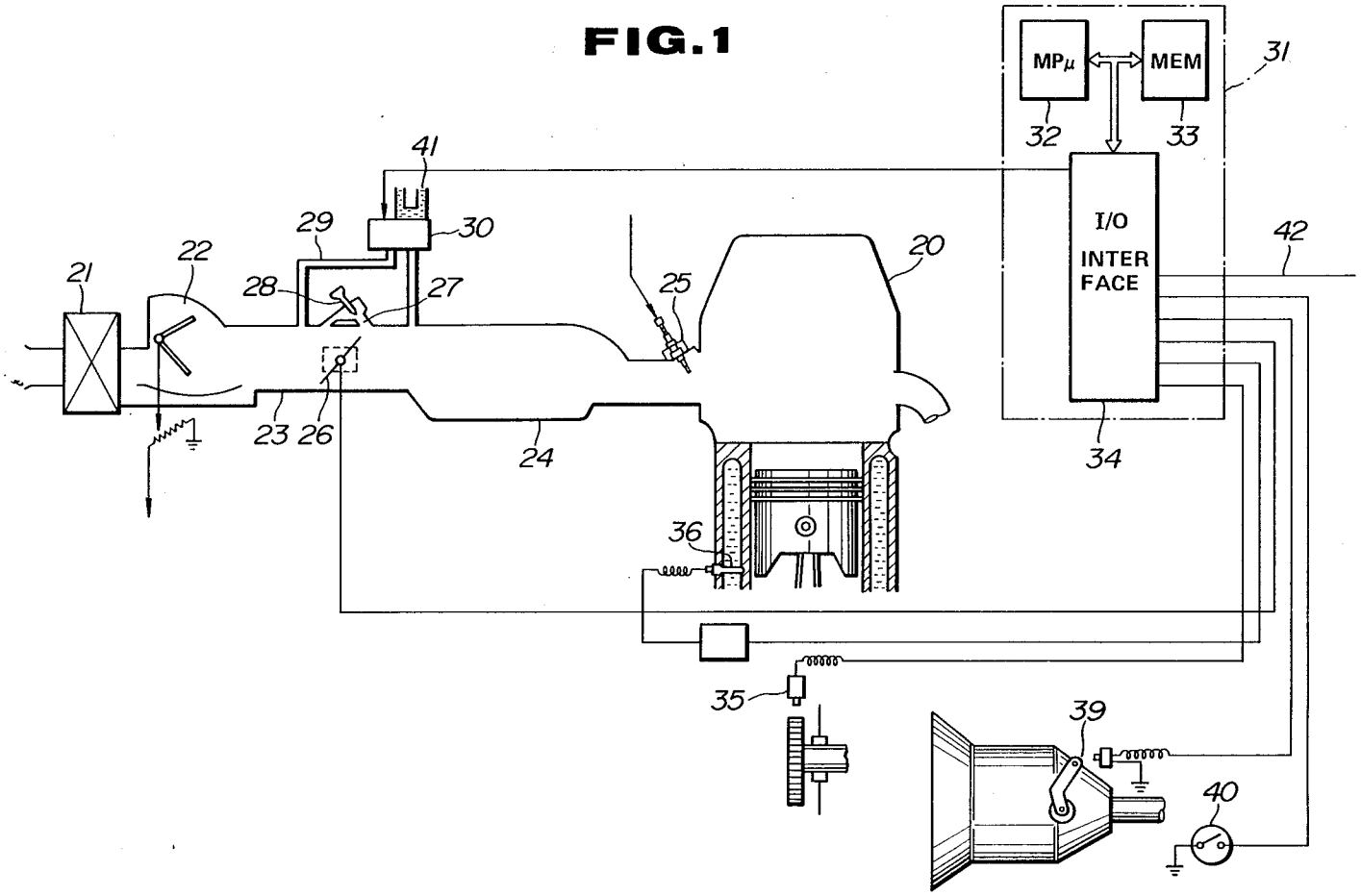
FIG. 1 is a schematic view of a system for controlling an engine idling speed for an internal combustion engine of a preferred embodiment according to the present invention.

FIG. 1 shows a construction of an internal combustion engine to which a system for controlling an engine idling speed according to the present invention is applicable.

An internal combustion engine 20 includes an air cleaner 21, airflow meter 22, and a throttle chamber 23. Intake air is supplied to each engine cylinder via the air cleaner 21, airflow meter 22, throttle chamber 23 and each branched passage. Fuel is injected via a fuel injector 25. The intake air is controlled by means of a throttle valve 26 which is linked with an accelerator (not shown). It is noted that the throttle valve 26 is substantially closed during an engine idling. A stream of intake air is passed through a bypass port 27 and adjusted by means of an idle adjusting screw 28. The intake air passes through the bypass passage 29 communicating a downstream and upstream of the throttle valve 26. A required air is suitably assured by means of an electromagnetic valve 30 for controlling the bypass airflow intervened across the throttle valve 26.

A microcomputer 31 controls an opening angle of the electromagnetic valve 30. The microcomputer 31 includes a microprocessor 32, a memory 33, and I/O interface 34.

The I/O interface 34 receives a digital signal from an engine speed sensor 35 indicating the engine revolution speed of the engine 20. The cooling water temperature of the engine 20 is detected in a form of an analog signal by means of a cooling water temperature sensor 36 and transmitted in the interface 34 in a form of a digital signal converted by means of an A/D converter 37.

The I/O interface 34 receives an on or off signal from a throttle valve switch 38 detecting whether the throttle valve 38 is at a fully closed position, a neutral switch 39 detecting whether a transmission is at a neutral position, and a vehicle speed switch 40 detecting whether the vehicle speed is below a predetermined value, e.g., 10 km/h.

The memory 33 of the microcomputer 31 stores an optimum idling speed corresponding to the cooling water temperature, the control integration coefficient (I) and control proportional coefficient (P), the feedback control coefficients for correcting a controlled value of an optimum opening angle of the electromagnetic valve 30 corresponding to the cooling water temperature. The microprocessor 32 retrieves a target engine idling speed and a feedback control coefficient value (data) corresponding to the cooling water temperature signal inputted in the I/O interface, compares the value of the target idling speed with the actual engine speed value inputted in the I/O interface 34, and outputs a digital signal such that the engine idling speed reaches the target value via the I/O interface 34. A circuit, e.g., constituted by a triangular wave generator and comparator converts the digital signal into a voltage duty ratio to control an opening angle of the electromagnetic valve 30.

Figure 3:
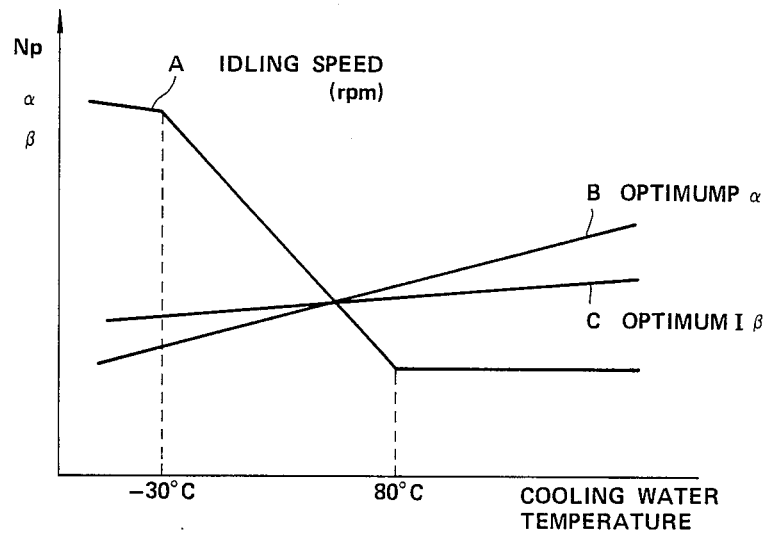
FIGS. 3 and 4 are characteristic graphs of a target engine idling speed, control coefficients, airflow quantity, and voltage control duty ratio.

It is noted that a characteristic of the target idling speed corresponding to the cooling water temperature is shown by A in FIG. 3. The characteristics of the integration coefficient (I) and proportional coefficient (P) are shown by C and B in FIG. 3.

The structure of the electromagnetic valve 30 will be described with reference to FIG. 2.

Figure 2:
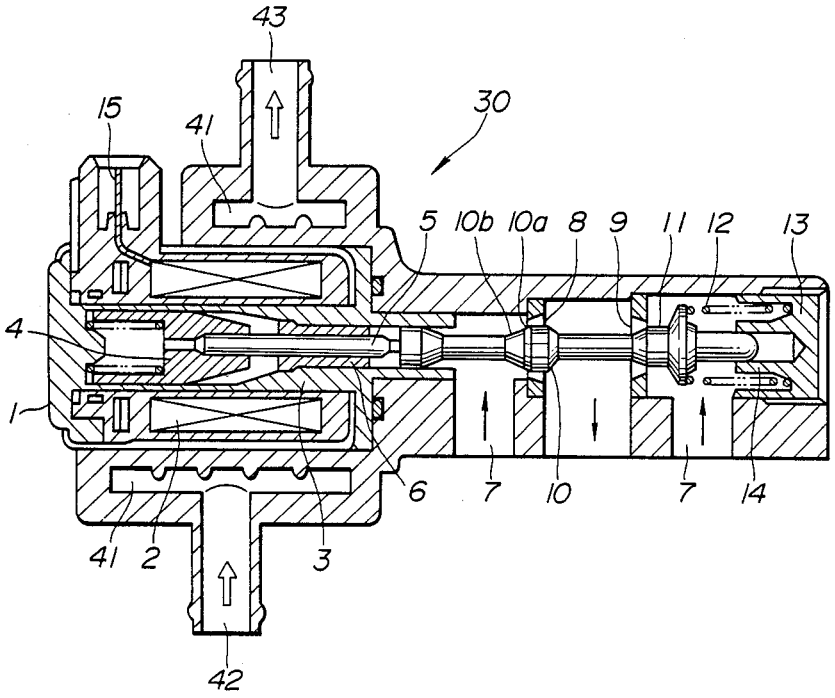
FIG. 2 is a schematically sectional view of an electromagnetic valve used in the engine idling speed controlling system shown in FIG. 1.

In FIG. 2, numeral 1 denotes a proportional electromagnetic driver, numeral 2 denotes a coil, numeral 3 denotes a core, numeral 4 denotes a plunger, numeral 5 denotes an output axle whose stroke has a proportional relationship to an input current of the proportional electromagnetic driver 1, numeral 6 denotes a bearing, numeral 7 denotes an air passage, numerals 8 and 9 denote orifices, numerals 10 and 11 denote valve, numeral 12 denotes a spring, numeral 13 denotes an adjustment screw, numeral 14 denotes a valve guide, numeral 15 denotes a power supply terminal. When a voltage duty ratio signal is applied to the power supply terminal 15 from the microcomputer 31, an electromagnetic force generated from the coil 2 causes the plunger 4 to be attracted to the core 3 against a spring force of the spring 12 so that the plunger 4 moves toward a right direction as viewed from FIG. 2.

Thus, the orifices 8 and 9 are opened by means of the valves 10 and 11 so that the bypassed air through the air passage 7 flows and the engine idling speed is controlled.

In addition, the water jacket 41 is formed so as to enclose an accomodating portion of the coil 2.

The water jacket 41 is provided with a cooling water inlet passage 42 and outlet passage 43 for circulating the engine cooling water.

The engine cooling water is controlled at a predetermined temperature (e.g., 80° C.) by means of a thermostat provided in the engine cooling water circulating system. The water jacket 41 constitutes heating means for heating the coil 2 of the electromagnetic valve 30 to the engine cooling water temperature which is maintained at the predetermined temperature.

The structure of the electromagnetic valve 30 and the bypass passage located at the electromagnetic valve 30 is exemplified by a Japanese Utility Model Application First Publication sho 62-57750 published on Apr. 10, 1987. One of the valves 10 is formed with a gradually inclined portion 10*a* and an abruptly inclined portion 10*b*. The change characteristic of the airflow quantity with respect to a magnetic force generated on the coil 2 is such that when the magnetic force is increased to approximately 50%, the airflow quantity is proportionally increased and when the magnetic force is increased to 100%, the airflow quantity is more steeply increased. It is noted that a copper wire used in the coil 2 of the electromagnetic valve 30 has a positive temperature resistance coefficient. The resistance becomes increased and the magnetic force becomes decreased as the engine cooling water temperature rises. Hence, when the engine cooling water temperature is, e.g., 80° C. and the voltage duty ratio is 100%, the magnetic force becomes about 60%. When the engine cooling water temperature is 110° C. and the voltage duty ratio is 100%, the magnetic force becomes about 50%. When the engine cooling water temperature is −30° C. and the voltage duty ratio is 100%, the magnetic force becomes 100%. In this way, the water jacket 41 is installed on a periphery of the coil 2 of the electromagnetic valve 30 so that the magnetic force generated on the coil 2 is varied according to the cooling water temperature. The change characteristic of the airflow quantity is set so as to vary for each cooling water temperature as shown by a graph of FIG. 4. Since in this way the cooling water temperature after the engine has warmed up is in a generally operable range of 80° C. to 110° C., the temperature of the coil 2 falls in that range. The maximum airflow quantity in that range is remarkably reduced as compared with the case of the electromagnetic valve disclosed in a Japanese Utility Model Application Publication sho 57-58181 when the cooling water temperature is 80° C. This value of the airflow quantity is a value at which the target engine idling speed can be achieved overcoming such loads as air conditioner of the vehicle, power steering, electric load, and so on.

An operation of the engine idling speed controlling system in the preferred embodiment will be described with reference to FIG. 5.

Figure 5:
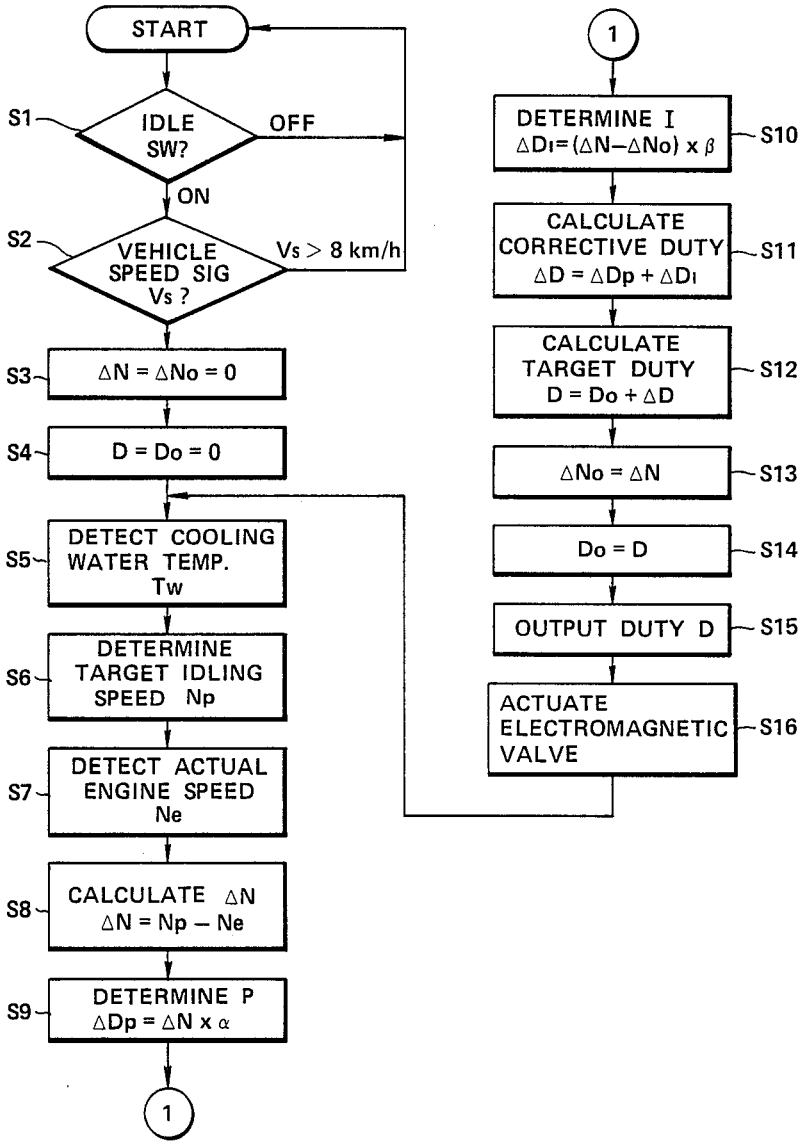
FIG. 5 is a processing flowchart executed in the engine idling speed controlling system shown in FIG. 1.

It is noted that a symbol S denotes a step in FIG. 5.

In a step 1 and a step 2, the microprocessor 32 determines whether the idle switch 26 is turned on or off and the vehicle speed $V_S$ is below a predetermined value to determine whether the present engine operation is in the engine idling state. If the present engine operation is in the engine idling condition, the routine goes to a step 3 and step 4 in which the engine speed difference $\Delta N$ and the target duty ratio D are initialized and the routine goes to a step 5.

In a step 5, the engine cooling water temperature is detected. In a step 6, the target engine speed $N_P$ corresponding to the detected cooling water temperature is read from the map of the characteristic shown in FIG. 3. In a step 8, the difference $\Delta N$ between the target engine speed $N_P$ and the actual engine speed $N_e$ is calculated. Next, the proportional control coefficient $\Delta D_P$ and integration control coefficient $\Delta D_I$ are determined in the following way.

First, the proportional feedback control coefficient $\alpha$ is read from the map of the characteristic shown in FIG. 3 corresponding to the cooling water temperature $T_W$. From a product of $\alpha$ and $\Delta N$, the proportional control coefficient $\Delta D_P$ is calculated. In a step 10, the integration feedback control coefficient $\beta$ corresponding to the engine cooling water temperature $T_W$ is read from the map of the characteristic shown in FIG. 4. The integration feedback control coefficient $\Delta D_1$ is calculated in the equation, $\Delta D_1=(\Delta N-N_o)\beta$ from $\beta$, $\Delta N$, and calculated value $\Delta N_o$ of the previous $\Delta N$.

In a step 11, the corrective duty $\Delta D$ is calculated. In a step 12, the target duty is calculated using the corrective duty $\Delta D$ and previous target duty $D_o$. In a step 13, the present engine speed difference $\Delta N$ is replaced with the previously calculated $\Delta N_o$ for the following calculation. In a step 14, the previous target duty $D_o$ is replaced with the presently calculated target duty D. In a step 15, the target duty D is outputted to drive the electromagnetic valve 30 in a step 16.

Figure 4:
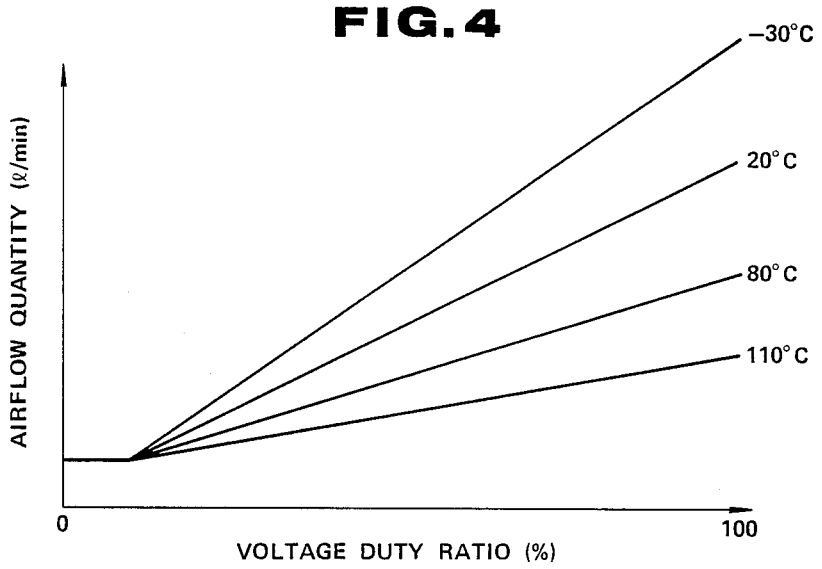

In the preferred embodiment, since the airflow quantity characteristic to the voltage duty of the electromagnetic valve 30 is set so as to vary for each cooling water temperature as shown in FIG. 4, the maximum airflow quantity at a predetermined temperature of the coil 2 after the engine has warmed up can be reduced to the required airflow quantity. Therefore, the stability can be maintained. If the feedback control is carried out so that the engine idling speed reaches the target idling speed corresponding to the cooling water temperature, the feedback control coefficients, i.e., the integration coefficient (I) and proportional coefficient (P) are varied according to the cooling water temperature during the idling operation, a time taken to reach the target idling speed can be shortened. In addition, a stable engine idling speed control can be achieved without a hunting in a vicinity of the target engine idling speed.

As described hereinabove, since in the engine idling speed controlling system and method according to the present invention, heating means for heating the coil of the electromagnetic valve to the engine cooling water temperature is provided and the airflow quantity characteristic is varied so as to correspond to the change in the cooling water temperature, the maximum airflow quantity of the electromagnetic valve at the predetermined coil temperature after the engine has warmed up is reduced to the required airflow quantity, the security of the engine for the increase in the engine idling speed can be maintained. In addition, since the optimum target engine speed and optimum feedback control coefficient are varied according to the engine cooling water temperature during the engine idling, a time taken to arrive at the target engine idling speed can be shortened and a stable engine idling speed control can be achieved.

It will be appreciated by those skilled in the art that the foregoing description is made in terms of the preferred embodiment and the various changes and modifications can be made without departing from the scope of the present invention which is to be defined by the appended claims.

What is claimed is:

1. A system for controlling an engine idling speed for an internal combustion engine, comprising:

(a) first means for detecting an engine operating condition, the first means including a first sensor for detecting an engine speed and a second sensor for detecting an engine coolant temperature;

(b) second means for determining whether the engine falls in an engine idling condition on the basis of the engine operating condition;

(c) third means for controlling a fluid flow quantity passing through a bypass passage installed in an intake passage of the engine when the engine falls in the engine idling state on the basis of an input signal having a controlled duty ratio, the duty ratio having a feedback control proportional coefficient and a feedback control integration coefficient and being varied according to the engine coolant temperature, so that the engine speed detected by the sensor coincides with a target engine speed determined according to the engine operating condition; the third means having an electromagnetic valve installed in the bypass passage for opening and closing the bypass according to the input signal having the duty ratio determined according to the engine operating condition; and (d) fourth means for varying the fluid flow quantity characteristic of the third means according to the engine operating condition, the fourth means having fifth means for heating a coil portion of the electromagnetic valve to a temperature which coincides with the engine coolant temperature so that the fluid flow quantity characteristic of the electromagnetic valve is varied according to the engine cooling water temperature representing the engine operating condition.

2. A system for controlling an engine idling speed for an internal combustion engine, comprising:

(a) first means for detecting an engine operating condition, the first means including a sensor for detecting an engine idling speed;

(b) second means for determining whether the engine falls in an engine idling condition on the basis of the engine operating condition;

(c) third means for setting a target engine idling speed according to the engine operating condition;

(d) fourth means for controlling the engine speed according to the engine operating condition so that the engine speed coincides with the target engine idling speed when the second means determines that the engine falls in the engine idling condition, a control variable of the fourth means including a proportional control coefficient and integration control coefficient, at least one of both control coefficients being varied according to the engine operating condition said fourth means further including valve means for controlling airflow quantity passed through a bypass passage installed so as to enable intake air to pass therethrough toward internal engine cylinders during the engine idling on the basis of an input signal having a duty ratio, the duty ratio determining an opening angle of the valve means and being derived on the basis of the control variable, and fifth means for varying a change characteristic in the airflow quantity characteristic of the valve means according to the engine operating condition, said, valve means including an electromagnetic valve installed in the bypass passage and normally closing the bypass passage for opening and closing the bypass passage according to the input signal having the duty ratio;

said fifth means comprising a water jacket installed so as to enclose a coil portion of the electromagnetic valve, the water jacket passing an engine cooling water so as to heat the coil portion of the electromagnetic valve so that the change characteristic of the airflow quantity of the electromagnetic valve is varied according to the engine cooling water temperature; and wherein a valve portion of the electromagnetic valve is formed with a gradually inclined portion and steeply inclined portion, and a wire forming the coil portion thereof has a positive temperature resistance coefficient so that the maximum airflow quantity of the electromagnetic valve is reduced to a required airflow quantity after the engine has warmed up.

3. A system as set forth in claim 2, wherein the fourth means includes valve means for controlling airflow quantity passed through a bypass passage installed so as to enable intake air to pass therethrough toward internal engine cylinders during the engine idling on the basis of an input signal having a duty ratio, the duty ratio determining an opening angle of the valve means and being derived on the basis of the control variable, and fifth means for varying a change characteristic in the airflow quantity characteristic of the valve means according to the engine operating condition.

4. A system as set forth in claim 3, wherein the valve means includes an electromagnetic valve installed in the bypass passage and normally closing the bypass passage for opening and closing the bypass passage according to the input signal having the duty ratio and fifth means comprises a water jacket installed so as to enclose a coil portion of the electromagnetic valve, the water jacket passing an engine cooling water so as to heat the coil portion of the electromagnetic valve so that the change characteristic of the airflow quantity of the electromagnetic valve is varied according to the engine cooling water temperature.

5. A system as set forth in claim 4, wherein a valve portion of the electromagnetic valve is formed with a gradually inclined portion and steeply inclined portion and a wire forming the coil portion thereof has a positive temperature resistance coefficient so that the maximum airflow quantity of the electromagnetic valve is reduced to a required airflow quantity after the engine has warmed up.

6. A system as set forth in claim 2, wherein the fourth means varies both of the feedback control proportional and integration coefficients according to the engine operating condition.

7. A system as set forth in claim 6, wherein the fourth means determines the feedback control proportional coefficient according to a first difference between the target engine idling speed and actual engine speed and a first variable determined according to the engine operating condition in the way expressed as follows: ($\Delta D_P = \Delta N x \alpha$).

8. A system as set forth in claim 7, wherein the fourth means determines the feedback control coefficient according to a second difference between the present first difference and previous first difference and according to a second variable determined according to the engine operating condition in the way expressed as follows: ($\Delta D_I = (\Delta N - \Delta No) x \beta$).

9. A system as set forth in claim 7, wherein the duty ratio of the input signal is determined in the following equation: $D = D_o + \Delta D$, wherein $D_o$ is the previous duty ratio and $\Delta D = \Delta D_P + \Delta D_I$.

10. A system as set forth in claim 9, wherein the engine operating condition is an engine cooling water temperature.

11. A system as set forth in claim 10, wherein the first and second variables are increased as the engine cooling water temperature is increased.

12. A system as set forth in claim 11, wherein the increase of the first variable is large as compared with the increase of the second variable.

13. A system as set forth in claim 5, wherein the characteristic of the airflow quantity is such that as the engine cooling water temperature increases the airflow quantity is decreased.

14. A method for controlling an engine idling speed for an internal combustion engine, comprising the steps of:

(a) detecting an engine operating condition including the engine idling speed by detecting engine speed and engine coolant temperature;

(b) determining whether the engine falls in the engine idling condition on the basis of the engine operating condition detected in the step (a);

(c) setting a target engine idling speed according to the engine operating condition; and (d) controlling the engine idling speed according to the detected engine operating condition by controlling a fluid flow quantity passing through a bypass passage installed in an intake passage of the engine when the engine falls in the engine idling state on the basis of an input signal having a controlled duty ratio, the duty ratio having a feedback control proportional coefficient and a feedback control integration coefficient and being varied according to the engine coolant temperature, so that the engine speed detected coincides with a target engine speed determined according to the engine operating condition; and opening and closing the bypass passage according to the input signal having the duty ratio determined according to the engine operating condition; varying the fluid flow quantity characteristic according to the engine operating condition, so that the fluid flow quantity characteristic is varied according to the engine cooling water temperature so as to represent the engine operating condition; so that when the engine falls in the engine operating condition, the engine idling speed coincides with the target engine idling speed, a control variable thereof including a proportional control coefficient and integration control coefficient, both of which are varied according to the engine operating condition.

15. A method as set forth in claim 14, wherein the step (d) includes the step of controlling a change characteristic of electromagnetic valve means provided for controlling the airflow quantity according to the engine operating condition, the electromagnetic valve means installed so as to enable a bypass passage of an engine throttle valve to pass the controlled airflow to engine cylinders during the engine idling.

16. A system for controlling an engine idling speed for an internal combustion engine, comprising:

(a) a bypass passage bypassing an engine driving force adjusting mechanism of the engine;

(b) an electromagnetic valve installed in the bypass passage for controlling an intake air quantity flowing through the bypass passage;

(c) heating means for heating a coil portion of the electromagnetic valve to a temperature which accords with a temperature of an engine coolant temperature so that the airflow quantity passing through the bypass passage and electromagnetic valve is varied so as to correspond to the engine coolant temperature;

(d) first control means for detecting an engine operating condition including an engine speed and engine coolant temperature and controlling in a feedback mode a controlled variable of the electromagnetic valve so that an engine idling speed coincides with a target engine idling speed determined according to the engine operating condition; and (e) second control means for varying the target engine idling speed so as to correspond to the engine coolant temperature and varying coefficients of the feedback control to correct a controlled variable of an opening angle of the electromagnetic valve.

* * * * *